United States Patent [19]

Takatsuru

[11] Patent Number: 4,581,964

[45] Date of Patent: Apr. 15, 1986

[54] FASTENER DRIVING TOOL WITH IMPROVED MAGAZINE AND FEED MECHANISM

[75] Inventor: Mitsuhiro Takatsuru, Takasaki, Japan

[73] Assignee: Max Co. Ltd., Tokyo, Japan

[21] Appl. No.: 704,474

[22] Filed: Feb. 22, 1985

[51] Int. Cl.[4] ..... B25B 19/00; B25B 21/00

[52] U.S. Cl. ..... 81/464; 81/434; 81/435; 227/136; 227/120

[58] Field of Search ..... 81/463, 464, 434, 435; 227/130, 132, 136, 120

[56] References Cited

U.S. PATENT DOCUMENTS

| | | | |
|---|---|---|---|
| 3,450,255 | 6/1969 | Mosetich | 227/136 |
| 3,543,987 | 12/1970 | Obergfell | 227/136 |
| 3,885,669 | 5/1975 | Potucek | 206/338 |
| 4,508,254 | 4/1985 | Fujiwara | 227/136 X |

FOREIGN PATENT DOCUMENTS 57-46991 10/1982 Japan .

*Primary Examiner*—Paul A. Bell

*Attorney, Agent, or Firm*—Cushman, Darby & Cushman

[57] ABSTRACT

A fastener driving tool comprising a tool body defining a fastener drive track, a fastener driver mounted in the drive track for movement through successive drive and return strokes, a magazine providing a space for retaining a coiled strip of fasteners, a guide passage leading from the magazine to the drive track along which a leading end portion of the strip with supported fasteners can be moved, and a fastener feeding mechanism for moving the leading end portion of the strip with fasteners along the guide passage. The feeding mechanism includes a L-shaped member having a horizontally extending portion and a vertical portion extending upwardly therefrom. The L-shaped member is disposed with respect to the guide passage such that the horizontal extending portion extends through a continuous longitudinal gap in the strip and the vertically extending portion extends alongside the inner surface of the continuous wall of the strip defining the upper portion of the gap. The feeding mechanism also includes a feeding pawl mounted for movement through successive operative cycles each of which includes a feed stroke and a return stroke, and a piston and cylinder unit for effecting movement of the pawl such that the same will be engaged within one of a series of notches formed in the lower edge of the continuous wall of the strip at the end of each return stroke so that the strip will be moved with the pawl during the drive stroke thereof.

9 Claims, 18 Drawing Figures

FIG. 4a
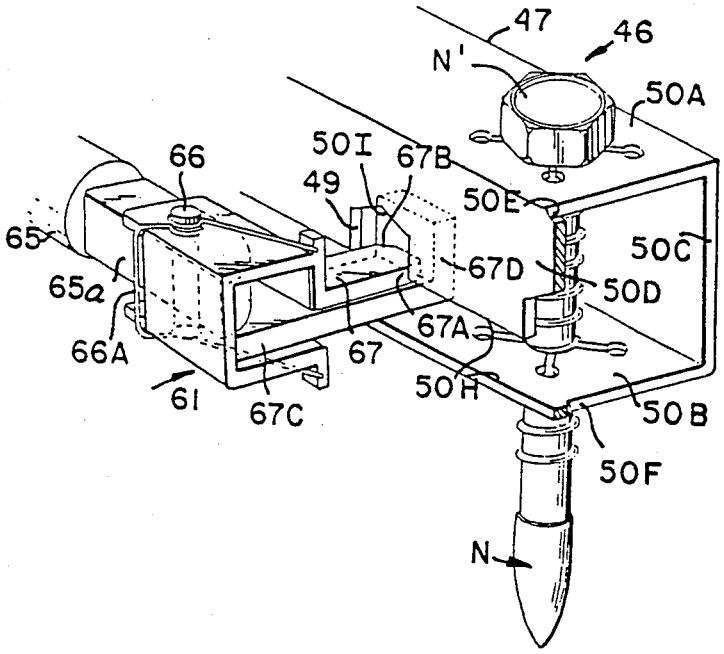
FIG. 4b
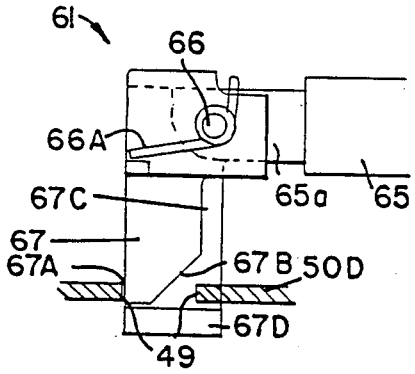
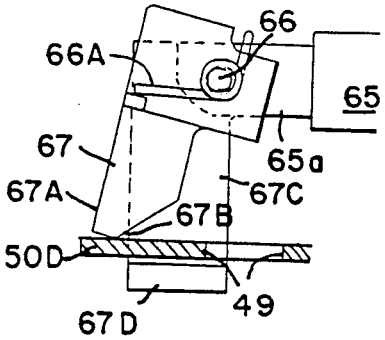
FIG. 4c

FASTENER DRIVING TOOL WITH IMPROVED MAGAZINE AND FEED MECHANISM

The present invention relates to fastener driving devices and more particularly to fastener driving devices of the type adapted to drive fasteners held in a plastic strip capable of being formed into a rolled or coiled package.

Devices of the type herein contemplated are exemplified by the nailer tool disclosure in U.S. Pat. No. 3,543,987. U.S. Pat. No. 3,450,255 discloses a nail fastener package used with the device. Another example of a device as herein contemplated is the screw driving tool disclosed in U.S. Pat. No. 3,450,255. The screw fastener package used with this device is disclosed in U.S. Pat. No. 3,885,669.

Still another device which exemplifies the devices herein contemplated is the combined impacting and turning tool disclosed in Japanese patent publication No. 46991/82 published Oct. 6, 1982. A preferred bullet pointed screw fastener package for use with the impacting and turning tool is disclosed in commonly assigned U.S. application Ser. No. 704,476 now abandoned filed concurrently herewith.

The present invention is more particularly concerned with improving the driving action irrespective of the particular fastener being driven (i.e. whether a nail or a screw or a combination thereof). The present invention relates to the tool structure which handles the fastener strip supporting the fasteners so as to enable the fasteners to be carried and driven in a more reliable fashion. Conversely, for the tool to achieve such reliability requires cooperation with a particular type of fastener plastic strip carrier.

A fastener plastic strip carrier of the type disclosed in U.S. Pat. No. 3,450,255 or 3,885,669 supports the fastener by a pair of hinged carrier tabs each having a fastener receiving slot which allows the fastener to be stripped laterally therefrom during the driving movement. As the fastener head moves downwardly during the driving movement, the tabs are engaged and hinged downwardly. The action is such that as the fastener is driven, a transverse pull is imposed upon the fastener shank so that its pointed end may be moved in the drive track in an inclined position. If the size of the slot is enlarged so as to reduce the pull, the fastener has a greater tendency to be accidentally stripped from the carrier in the tool magazine or elsewhere.

The strip feeding mechanism in the tool using the hinged tab plastic strip is constructed to have a pawl member which engages a portion of the strip to push and feed the strip forwardly. The strip is subject to being deformed since it is usually made of a thin plastic sheet. In some instances, the strip is deformed so far as to fail to engage with the pawl member thereby to cease its supply, thus raising a serious defect that the strip is not supplied reliably.

It is an object of the present invention to provide a tool which will obviate the disadvantages noted above. In accordance with the principles of the present invention the tool of the present invention preferably utilizes a coiled fastener package of the type disclosed in the aforesaid application which includes a multiplicity of fasteners supported in vertically extending parallel row formation by a horizontally elongated thin walled plastic carrier strip. The carrier strip includes a series of longitudinally spaced pairs of upper and lower fastener retaining walls, each pair of upper and lower walls extending generally horizontally and being disposed in generally vertical spaced parallel relation with respect to one another, a vertical wall connected between one pair of corresponding edges of each pair of upper and lower walls, the lower walls being longitudinally interconnected at their edges opposite from the one edge, and a continuous wall longitudinally interconnecting the upper walls at their edges opposite from the one edge. The continuous wall extends vertically downwardly from the opposite edges of the upper walls and terminates in a lower edge forming a continuous longitudinally extending gap therebelow and above the interconnected opposite edges of the lower walls. The upper and lower walls have longitudinally spaced aligned pairs of openings formed in central areas thereof configured to releasably support the fasteners with their axes extending vertically in a parallel row formation with respect to one another in such a way that each fastener including the head thereof can be moved axially from the pair of walls supporting the same without substantially unbalanced transverse forces being applied thereto. The lower edge of the continuous wall has a multiplicity of feeding notches therein opening into the gap spaced apart a longitudinal distance generally equal to the longitudinal spacing between fasteners.

In accordance with the principles of the present invention the tool includes a tool body defining a fastener drive track, a fastener driving element mounted in the drive track for movement through successive operative cycles each including a providing interior space for retaining a coiled carrier strip with supported fasteners, a guide passage leading from the magazine to the drive track along which a leading end portion of the strip with supported fasteners can be moved, and a fastener feeding mechanism for moving the leading end portion of the strip with fasteners along the guide passage. The feeding mechanism includes an L-shaped member having a horizontally extending portion and a vertical portion extending upwardly therefrom. The L-shaped member is disposed with respect to the guide passage such that the horizontal extending portion extends through the gap in the strip and the vertically extending portion extends alongside the inner surface of the continuous wall of the strip. The feeding mechanism also includes a feeding pawl mounted for movement through successive operative cycles each of which includes a feed stroke and a return stroke, and a piston and cylinder unit for effecting movement of the pawl such that the same will be engaged within a strip notch at the end of each return stroke so that the strip will be moved with the pawl during the drive stroke thereof.

Another difficulty with prior art tools of the type described arises from the fact that fasteners used with tools of this kind have several different lengths according to their applications. Therefore, in order to move these fasteners out of the magazine toward the supply passage, the magazine is required to be equipped with some adjusting means to accommodate the different lengths of the fasteners. Each time a different kind of fastener is used, the adjusting means must be readjusted in a complicated manner.

Accordingly another object of the present invention is to alleviate the problems of magazine adjustment noted above. In accordance with the principles of the present invention this objective is obtained by providing a magazine which includes a fixed section and a movable section mounted with respect to the fixed section for movement between a closed operative position and an opened access position. The fixed section includes a fixed circular bottom wall, a fixed semi-cylindrical peripheral wall extending upwardly from a peripheral edge portion of the bottom wall, and a fixed semicircular top wall extending from the upper edge of the fixed peripheral wall. The movable section includes a movable semi-cylindrical peripheral wall and a movable semi-circular top wall extending from the upper edge of the movable peripheral wall. The movable walls are cooperable with the fixed walls when the movable section is in the closed operative position to define a cylindrical space for receiving a coiled fastener package selected from a series of coiled fastener packages having different axial dimensions dependent upon the length of the shanks of the fasteners in the coiled package. Mounted on the fixed bottom wall is a spring fixed in a position to engage the bottom of the coiled package so as to support the same with the headed ends of the fasteners thereof adjacent the top walls when the movable section is in its closed operative position.

These and other objects of the present invention will become more apparent during the course of the following detailed description and appended claims.

The invention may be best understood by an illustrative embodiment is shown.

Figure 3:
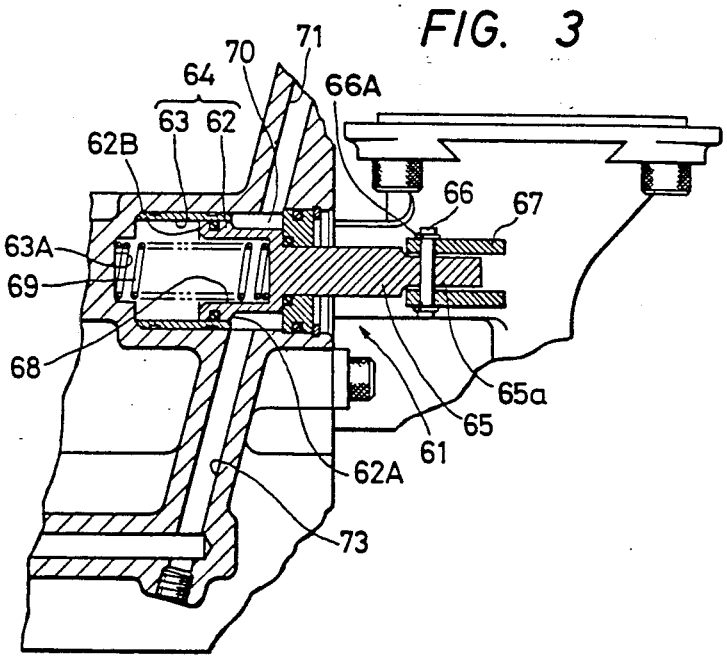
FIG. 3 is a vertical cross sectional view of the screw feed mechanism of the tool shown in FIG. 1.

FIG. 4*a* is a perspective view of the screw feed mechanism shown in FIG. 3;

FIGS. 4*b* and *c* are plan views of the feed mechanism of FIG. 4*a* showing the same in two different positions of movement.

Figure 1:
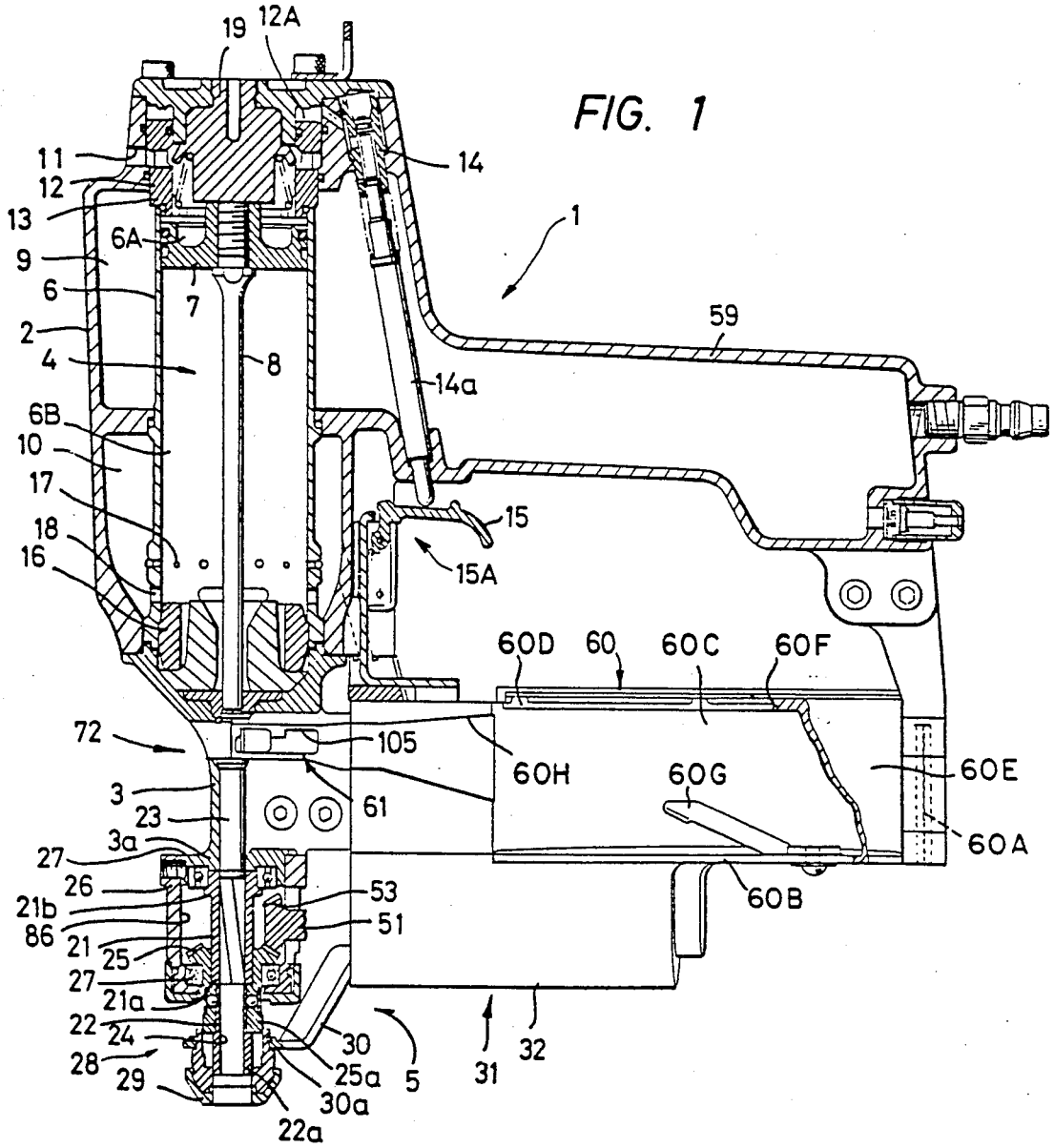
FIG. 1 is a vertical sectional view of an impacting and turning tool having a feed mechanism and a novel magazine embodying the principles of the present invention.
Figure 5:
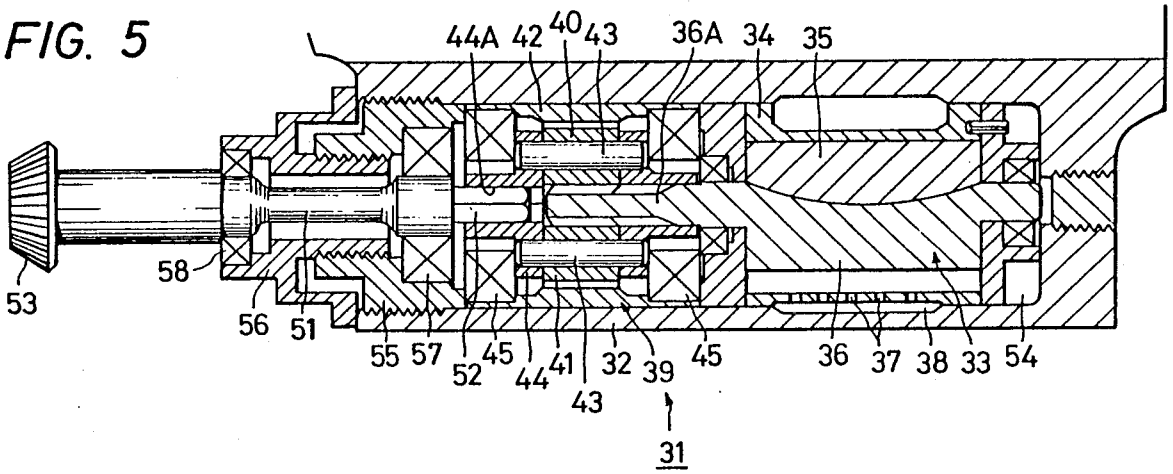
Figure 6:
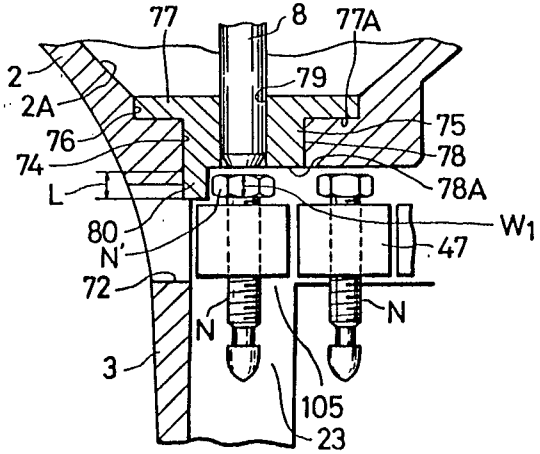
Figure 7A:
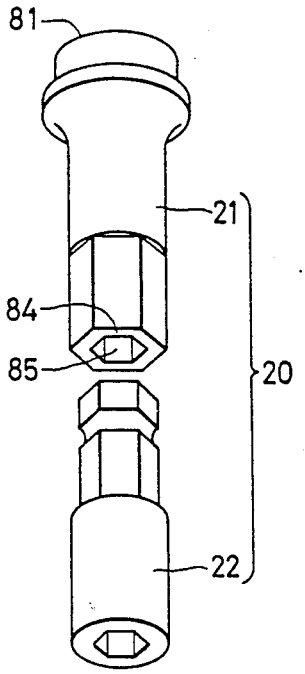
Figure 7B:
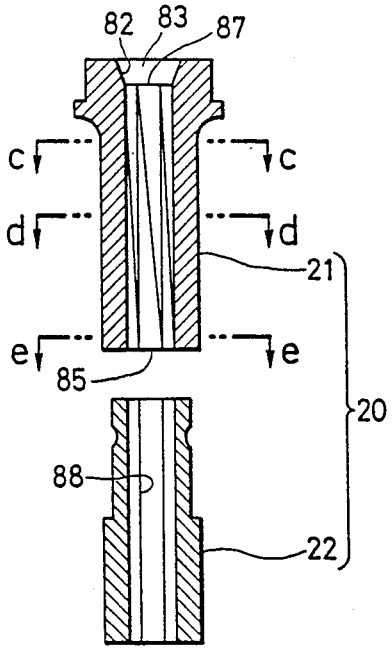
Figure 7C:
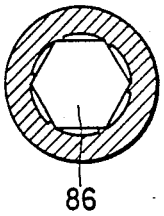
Figure 7D:
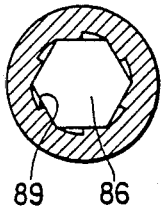
Figure 7E:
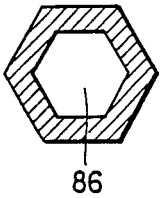

FIG. 5 is a longitudinal sectional view of the socket driver of the tool shown in FIG. 1;

FIG. 6 is a longitudinal sectional view showing the joining portion of the tool body and the nose of the tool shown in FIG. 1;

FIG. 7*a* is a perspective view of the socket of the tool;

FIG. 7*b* is a longitudinal sectional view of the socket;

FIGS. 7*c* to 7*e* are sectional views taken along lines *c—c, d—d* and *e—e,* respectively, of FIG. 7*b;*

Figure 7F:
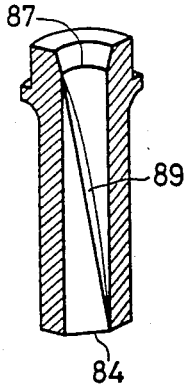
Figure 8:
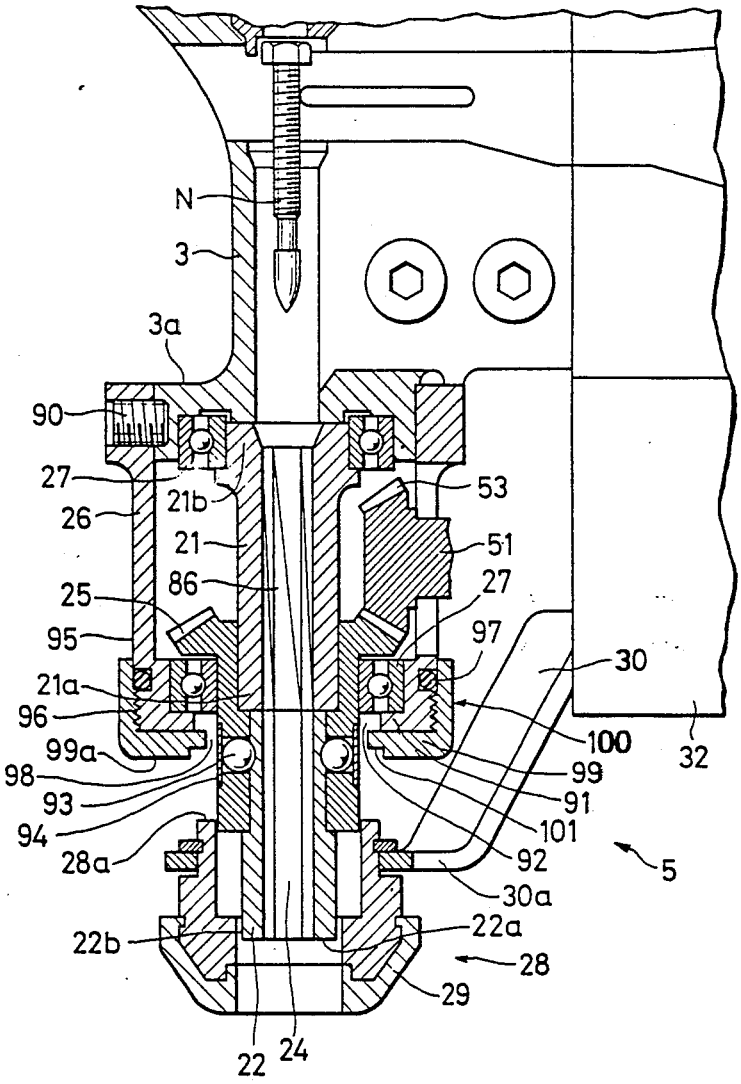
Figure 11:
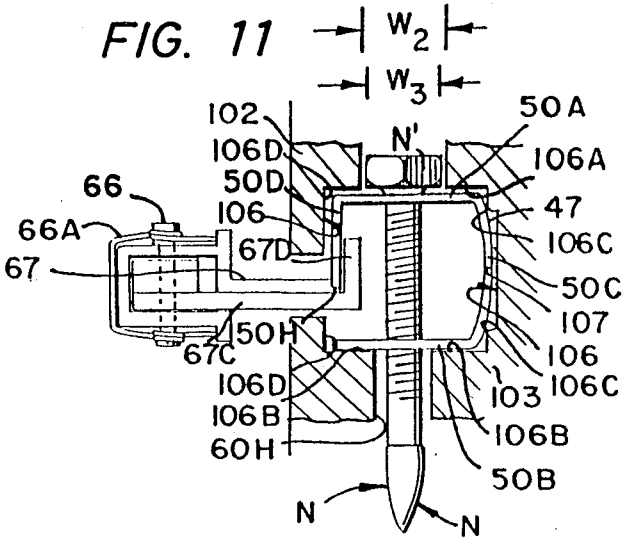
Figure 10:
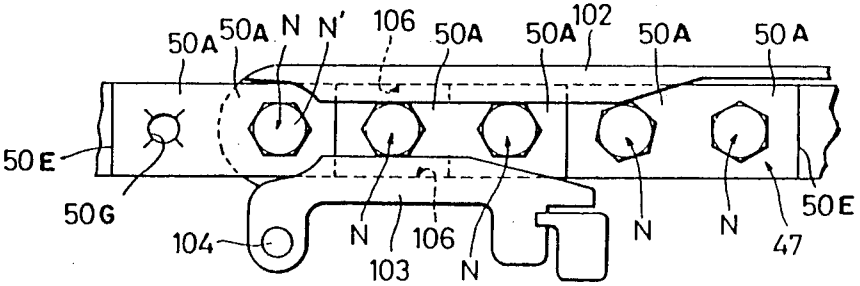
Figure 9:
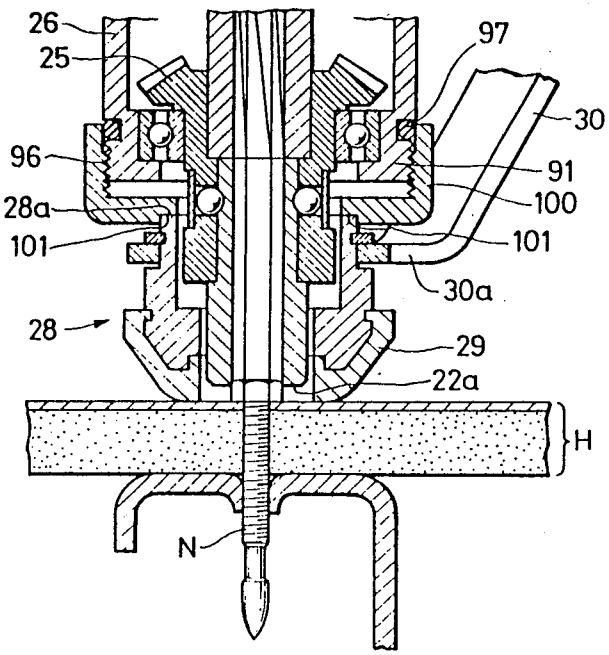

FIG. 7*f* is a cut-away view showing the socket, especially, the introducing portion and the guide portion thereof;

FIG. 8 is a longitudinal sectional view showing the screw tightening and depth adjusting means of the tool shown in FIG. 1;

FIG. 9 is a longitudinal sectional view showing the operating state of the screw tightening and depth adjusting means shown in FIG. 8;

FIG. 10 is a top plan view showing the screw feed passage of the present invention;

FIG. 11 is a longitudinal sectional view showing the manner in which the screw holding member is disposed in the screw feed passage shown in FIG. 10.

Referring now more particularly to the drawings, there is shown in FIG. 1 thereof a screw impacting and tightening tool, generally indicated at 1, which is constructed according to the principles of the present invention. The screw impacting and tightening tool 1 uses an air pressure as its drive source. As shown, the screw impacting and tightening tool 1 includes a tool body 2 having a nose 3 projecting from the lower end of the tool body 2; a screw striker 4 for impacting or striking a screw N, which has been fed to the nose 3, into a work H to be screwed (see FIG. 9); and a screw driver 5 which is arranged at the side of the leading end 3*a* of the nose 3 for turning the impacted screw N into the work H.

The screw striker 4 is composed of: a striking cylinder 6 disposed in the tool body 2; a striking piston 7 fitted slidably and sealingly in the striking cylinder 6; a striking piston rod 8 connected rigidly to the striking piston 7; a main air chamber 9 formed around the upper exterior end of the striking cylinder 6 for containing compressed air to drive the piston 7; a return air chamber 10 formed around the lower exterior end of the striking cylinder 6 for containing compressed air to return the striking piston 7; a head valve 12 arranged in the upper portion of the tool body 2 for switching the communication either between a piston upper chamber 6A of the striking cylinder 6 and the main air chamber 9 or between the piston upper chamber 6A and a discharge passage 11; and a trigger valve 14 disposed in the lower forward end portion of a hand grip portion 59 of the tool body 2 capable of transmitting an opening or closing signal to the head valve 12.

When the valve stem 14*a* of the trigger valve 14 is lifted by pulling up a trigger lever 15 which is hinged to one side of the tool body 2, the compressed air having been reserved in the piston upper chamber 12A of the head valve 12 is released to the atmosphere through the trigger valve 14. When the pressure of the piston upper chamber 12A is reduced to atmospheric pressure, the piston 13 of the head valve 12 is moved upward, as shown in FIG. 1, by the pressure of the compressed air in the main air chamber 9 to open the communication between the main chamber 9 and the piston upper chamber 6A and to close the communication between the discharge passage 11 and the piston upper chamber 6A. As a result, the striking piston 7 is abruptly moved downward, as shown in FIG. 1, by the pressure of the compressed air fed to the piston upper chamber 6A so that the striking piston rod 8 hits the screw N, which has been fed in advance into a screw inserting bore 23 of the nose 3, to drive the screw N out of the leading end 3*a* of the nose 3. When the striking piston 7 impinges upon an annular bumper 16, which is arranged in the lower end of the striking cylinder 6, simultaneously as the striking piston rod 8 strikes the screw N, the compressed air having been supplied to the inside of the piston upper chamber 6A is partially reserved via a plurality of perforations 17 in the aforementioned return air chamber 10. Incidentally, the compressed air reserved in the return air chamber 10 provides air for acutuating the screw driver 5 which will be described hereinafter.

When the aforementioned trigger lever 15 having been held in its pulled-up state is released, the valve stem 14*a* of the aforementioned trigger valve 14, which has been held in its lifted state, is returned to the initial position before the operation by the pressure of the compressed air in the main air chamber 9. As a result, the head valve piston 13 is returned downward, as shown in FIG. 1, by the pressure of the compressed air in the head valve piston upper chamber 12A to close the communication between the main air chamber and the piston upper chamber 6A and to open the communication between the piston upper chamber 6A and the discharge passage 11. As a result of the return of the head valve piston 13, the striking piston 7 is returned upward, as shown in FIG. 1, by the pressure of the compressed air, which flows from the return air chamber 10 via a plurality of slots 18, and so on into the piston lower chamber 6B, to restore the initial position before the operation. Incidentally, the return of the striking piston 7 is received by a piston stopper 19 which is made of an elastic member and arranged in the upper portion of the tool body 2.

Figure 2:
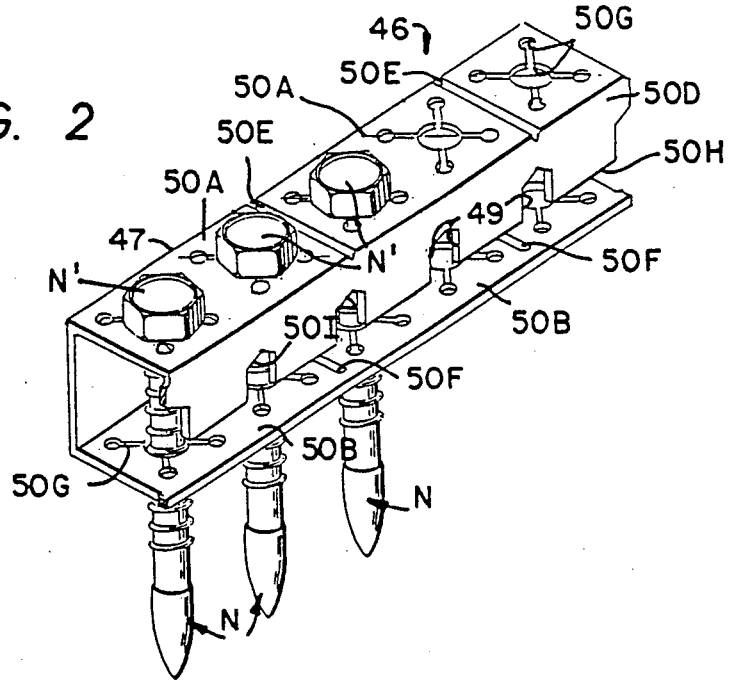
FIG. 2 is a perspective view of an assembled plastic carrier strip and bullet nosed screws used to form the fastener package used in the tool of the invention.

Carried by the tool body in a position below the hand grip portion 59 is a magazine 60 which is shaped to receive a coiled fastener package 46. Fastener package 46 is formed by rolling up an elongated fastener carrier assembly which includes an elongated plastic carrier strip 47 and a multiplicity of bullet nosed screws N. As best shown in FIG. 2, the carrier strip 47 for connecting and holding the bullet nosed screws that are used in the tool 1 according to the present invention is comprised of: a multiplicity of pairs of upper and lower retaining walls 50A and 50B disposed horizontally and spaced apart from each other in the direction of the axis of the screws; side walls 50C coupled to each one ends of each pair of upper and lower retaining walls 50A and 50B; and a continious connecting wall 50D formed integrally with the other ends opposite to the one ends of the upper retaining walls 50A.

The upper retaining walls 50A and the side walls 50C are each partitioned from the neighboring ones by slits 50E. Also, the lower retaining walls 50B are partitioned from the neighboring ones by slits 50F that extend from the one sides thereof toward the other sides and terminate in the vicinity of the other sides. The continuous connecting wall 50D coupled to the other sides of the upper retaining walls 50A extends continuously in the direction in which the screws are connected. Thus, the strip is formed continuously and long, and can be wound into a coil to form a package 46 to be received in the magazine 60. Each of the upper and lower retaining walls 50A and 50B is provided with a pair of X-shaped openings 50G through which the shanks of a pair of screws pass such that each pair of screws are connected together and retained with succeeding pairs.

The continuous connecting wall 50D extends downwardly from the other sides of the upper retaining walls 50A toward the other sides of the lower retaining wall 50B. A gap 50H is left between each lower end of the connecting wall 50D and each lower retaining wall 50B and extends in the direction in which the strip extends. A portion of a feed mechanism (described later) can be introduced into the strip through the gap 50H. The connecting wall 50D is provided in its lower edge portion with notches 50I which are formed at regular intervals equivalent to the pitch between the successively connected screws N.. Each notch 50I forms side walls 49 with which a pawl forming a part of the feed mechanism can engage.

Preferably, the carrier strip and screw assembly is wound into a coil formation on a cardboard reel or spool (not shown) which forms a part of the package 46. The spool consists of a cardboard tube forming a hub and a pair of centrally apertured circular cardboard sheets fixed to opposite ends of the tube by grommets of L-shaped cross-sectional configuration. The circular sheets form flanges the inner surfaces of which are disposed closely adjacent the points and heads respectively of the screws throughout the coil.

The package 46 including the spool is of a diameter size to fit within the magazine 60. The axial dimension of the spool will vary depending upon the shank length of the screws in the package. As shown, the magazine 60 comprises a fixed lower section secured to the tool body 2 and a movable section pivoted to the rearward vertical edge of the fixed section by a hinge 60A for movement between a closed operative position and an opened access or loading position.

The fixed section includes a lower circular bottom wall 60B, a semi-cylindrical peripheral wall 60C extending upwardly from one half the periphery of the circular bottom wall 60B and a semi-circular top wall or cover 60D extending from the upper edge of the semi-cylindrical peripheral wall 60C. The movable section includes a semi-cylindrical peripheral wall 60E and a semi-circular top wall or cover 60F extending from the upper edge thereof.

When the movable section is in its closed operative position, the two sections together define a cylindrical interior space of a diameter to receive the spool of the package 46.

In order to support the fastener package 46 so that the upper flange of the spool is always adjacent the top wall or cover irrespective of the axial dimension of the spool, a leaf spring or spring plate 60G is mounted within the lower portion of the magazine. As shown, one end of the spring plate 60G which is located close to the open end of the lower section is fixedly mounted to the bottom wall 60B. The other end of the spring plate 60G extends from the open end toward the peripheral wall 60C of the lower section of the magazine. When the movable section is in its opened position, a fastener package 46 can be loaded into the magazine without being obstructed by the spring plate 60G. That is, as the package is moved laterally into the fixed magazine section, the leading portion of the upper flange of the package spool passes beneath the top wall 60D so that as the movement continues, spring plate 60G will deflect downward an amount sufficient to accommodate the spool thickness or axial dimension. In this way, the head of each screw assumes a fixed postion whenever it moves out of the magazine irrespective of its shank length. The leading end portion of the strip 47 can be easily and satisfactorily delivered in a tapered rearward end of a feed passage 60H in the tool.

The feed passage 60H leads to a drive track or screw inserting bore 23 in the tool nose 3 within which the piston rod driver 8 reciprocatingly moves. A screw feeder 61 for feeding the leading screw in the leading end portion of the fastener package 46 into the screw inserting bore 23 is interposed between the magazine 60 and the nose 3. As best shown in FIGS. 3 and 4, the feeder 61 is composed of: a feed piston-cylinder mechanism 64, which has a feed piston 62 and a feed cylinder 63; and a screw feeding pawl 67 which is attached by means of a pivot pin 66 and hairpin spring 66A to the leading end **65*a* of a piston rod 65 projecting from one end face 62A of the feed piston 62. Moreover, the other end face 62B of the feed piston 62 is formed with a circular recess 68 in the axial direction, and a compression coil spring 69 for advancing the feed piston is sandwiched between that recess 68 and the rear end face 63A of the aforementioned feed cylinder 63. Moreover, a feed piston retracting air supply passage 71 is formed between a feed piston front chamber 70 in the feed cylinder 63 and the aforementioned return air chamber 10. Incidentally, the elastic force of the compression coil sping 69 is set to be weaker than the force which is exerted upon the feed piston by the pressure of the compressed air supplied to the feed piston front chamber 70**.

Feed piston 62 will be reciprocated between two limiting positions as the pressure conditions within chamber 70 are elevated and allowed to return to atmospheric conditions. When the pressure is raised, the feed piston 62 is moved through a return stroke and when allowed to lower to atmospheric pressure the feed piston 62 is moved through a feed stroke by spring 69. As the piston reciprocates, the pawl member 67 is moved back and forth along the strip 47. When it is moved forward, through a drive stroke the front end 67A of the pawl member 67 comes into engagement with the front side wall 49 of one notch 50H in the strip 47, moving the strip forward thus to perform feed operation. When the pawl member 67 is moved backward, its rear end 67B comes into contact with the rear side wall 49 of the notch 50I, so that the pawl member 67 is rotated from the position shown in FIG. 4*b* against the action of hairpin spring 66A. Then the pawl member 67 slides back on the inner surface of the connecting wall 50D of the strip 47, as shown in FIG. 4C. When the pawl member 67 is brought to its rearmost limiting position by the feed piston 62, the pawl member assumes a position corresponding to the next notch 50I in the strip. Then the pawl member 67 is rotated by the action of spring 66A back to the position at which it engages the side wall 49 of this notch 50I as shown in FIG. 4*b*.

Also securely fixed to the front end 65A of the piston rod 65 is a support member 67C that protrudes a considerable distance along the strip 47. The front end of the support member is bent upward and forms a vertical wall 67D corresponding to the front end 67A of the pawl member 67. The distance between them is set less than the thickness of the connecting wall 50D of the strip 47. This bent front end 67D goes into the strip through the above-described gap 50H in the strip 47 and this vertical wall 67D prevents the connecting wall 50D from deforming inwardly.

As the feed piston 62 makes a reciprocating motion, the support member 67C is moved back and forth in the direction in which the strip is fed. At this time, the vertical wall 67D is moved along the inner surface of the connecting wall 50D of the strip. This brings any portion which has been deformed inwardly back to the position at which it can be engaged by the pawl member 67. At the same time, the inward deformation of the portion is prevented. This ensures that the strip 47 for connecting together the screws N is guided from the magazine 60 to the driving position through the feed passage 60H with certainty.

The return stroke of the feed piston 62 is accomplished at the end of the drive stroke of the piston 7. As the piston 7 reaches the end of its drive stroke, the compressed air above the piston flows through the openings 17 into the return air chamber 10. This compressed air in the return air chamber 10 flows by way of the feed piston retracting air supply passage 71 into the feed piston front chamber 70. In this way, feed piston 62 is retracted to the left, as viewed in FIG. 3, against the elastic force of the compression coil spring 69 so that the feeding pawl 67 is held in a position prepared for feeding the screw N which is next to be fed to the screw inserting bore 23 of the nose 3.

Releasing the trigger lever 15 from its operating position vents the piston upper chamber 6A to the atmosphere through the head valve 12, moreover, the supply of the compressed air to the return air chamber 10 is blocked so that the compressed air in the return air chamber 10 flows into the lower chamber 6B below the piston 7. At the same time, the supply of the compressed air to the feed piston retracting air supply passage 71 is interrupted so that the feed piston 62 is moved again through a feed stroke by the elastic force of the compression coil spring 69. As a result, the feeding pawl 67 comes into engagement with the next notch 50I to feed the screw inserting bore 23 of the nose 3 with the screw N to be driven next. Incidentally, the screw holder 47, which has been holding the screw N already striken and driven, is pushed to the outside without being cut out through a screw holder push-out aperture 72 which is formed in the front side wall of the nose 3.

On the other hand, the screw driver 5 is constructed such that its operation is started by the compressed air which is supplied from the return air chamber 10 by way of an air motor actuating air supply passage 73 which leads from the feed piston front chamber 70 to a socket driver 31. This socket driver 31 is arranged in a cylindrical housing 32 which is formed integrally with the lower fixed section of the magazine 60.

As best shown in FIG. 5, the socket driver 31 is composed essentially of: a reduction gear mechanism 39 for reducing the turning force of an air motor 33 acting as a prime mover; and a spindle 51 for transmitting the turning force obtained through that reduction gear mechanism 39 to a socket unit 20.

The air motor 33 is made to have the wellknown construction in which a rotor 36 having a plurality of rotor blades 35 revolves within an air motor cylinder 34. The rotor 36 is rotationally driven by the compressed air which is supplied to the return air chamber 10 by way of the feed piston retracting air supply passage 71, feed piston front chamber 70, and air motor actuating air supply passage 73.

The air motor cylinder 34 is formed with a number of (e.g., five in FIG. 5) discharge ports 37, which are juxtaposed to one another in the axial direction so that the used air discharged from the discharge ports 37 is once made to reside in an air expansion chamber 38, which is formed around the air motor cylinder 34, and is discharged to the atmosphere by way of a silencer (not shown).

A drive shaft 36A which is made integral with the rotor 36 of the air motor 33, is formed into a shape of a gear having five teeth and is disposed in the reduction gear mechanism 39 to form the input shaft of the same mechanism 39. The reduction gear mechanism 39 is a speed changing mechanism of the type using planetary gears, in which two planetary gears 40 and 41 are in meshing engagement with the drive shaft 36A of the air motor 33. The planetary gears 40 and 41 mesh with a sun gear 42 which is fixed in the housing 32. The planetary gears 40 and 41 are rotatably attached by means of pins 43, respectively, to an annular collar 44 acting as the output shaft of the reduction gear mechanism 39. As a result, the collar 44 is rotationally driven by the revolutions of the planetary gears 40 and 41. Large-diameter bearings 45 are juxtaposed at a predetermined spacing to each other between the sun gear 42 and collar 44 to bear the collar 44 rotatably in the sun gear 42.

In the center hole 44A of the collar 44, moreover, there is fitted a polygonal portion 52, which is formed at the base portion of the spindle 51, so that the spindle 51 can revolve together with the collar 44. In order to transmit, the turning force of the spindle 51 to the socket unit 20, the spindle 51 is formed at its leading end integrally with a second bevel gear 53 which acts as a transmission gear meshing with a later-described first bevel gear 25. The spindle 51 is rotatably borne in bearings 57 and 58 which are respectively supported in a supporting cylinder 55 screwed in the housing 32 and in a housing cap 56.

As best shown in FIGS. 1, 7 and 8, the socket unit 20 is composed of: a cylindrical screw guide socket 21 arranged at the leading end 3*a* of the nose 3 for acting as a small screw guide member; and a screw turning socket 22 for acting as a screw turning member. The screw guide socket 21 has a function to guide the screw N having a hexagonal head N′, which is impacted by the drive piston rod 8, to the screw turning socket 22 through a screw guide passage 86 which is formed at the center of the screw guide socket 21. With the lower end portion 21*a* of the screw guide socket 21, there is integrally assembled the first bevel gear 25 which is in meshing engagement with the second bevel gear 53.

The screw guide socket 21 is supported by a cap-shaped socket holder 26 such that the screw guide passage 86 is aligned with the screw inserting bore 23 of the nose 3. Between the outer circumference of the upper end portion 21*b* of the screw guide socket 21 and the inner circumferential wall of the socket holder 26 and between the outer circumference of the first bevel gear 25 and the inner circumferential wall of the socket holder 26, there is sandwiched a bearing 27 in which the screw guide socket 21 is so borne that it can rotate on its axis.

On the other hand, the screw turning socket 22 is arranged at the lower end portion 21*a* of the screw guide socket 21. The screw turning socket 22 is formed at its center with a screw fitting bore 24 having a hexagonal section for fitting and holding the head N′ of the screw N in position and thus functions to retain in the screw fitting bore 24, the head N′ of the screw N which has been partially driven into the work H through the screw guide passage 86 of the screw guide socket 21 by the action of the drive piston rod 8, and to further drive the screw N into the work H when it is rotationally driven by the socket driver 31. Moreover, the screw turning socket 22 has its outer circumference so fitted and held by the first bevel gear 25 having its one end 25*a* projecting from the lower end portion 21*a* of the screw guide socket 21 that its screw fitting bore 24 is aligned with the screw guide passage 86 of the screw guide socket 21.

Around the leading end portion 22*a* of the screw turning socket 22, on the other hand, there is arranged movably in the axial direction of the screw turning socket 22 an attachment 28 which is provided at its leading end with a shock absorber 29 adapted to contact with the surface of the work H to be screwed. That attachment 28 is supported by the leading end portion 30*a* of a contact arm 30 which is enabled to send an operation signal to the screw striker 4 while allowing the pulling-up operation of the trigger lever 15 of the trigger 15A. The attachment 28 is elastically biased downward at all times by spring means (not shown) which is mounted on the contact arm 30.

One cycle of the pneumatic type screw tightening tool 1 having the construction thus far described will be generally explained in the following.

When the shock absorber 29 at the leading end of the attachment 28 is thrusted onto the work H to lift the contact arm 30 and when the trigger arm 15 is pulled up, the screw N, which has been fed in advance to the screw inserting bore 23 of the nose 3, is driven out of the leading end of the nose 3 into the work H by the action of the drive piston rod 8. When the striking piston 7 reaches its bottom dead center in accordance with the driving operation of the screw N, the compressed air supplied into the return air chamber 10 flows via the feed piston retracting air supply passage 71 into the feed piston front chamber 70 of the feed cylinder 63 to drive backward the feed piston 62 thereby to retract the screw feeding pawl 67. Simultaneously with the retraction of the screw feeding pawl 67, moreover, the compressed air in the return air chamber 10 is introduced by way of the feed piston retracting air supply passage 71, the feed piston front chamber 70 and the air motor actuating air supply passage 73 into an air motor actuating air reservoir 54, which is formed at the righthand end in the housing 32, to rotationally actuate the air motor 33. Moreover, this turning force of the air motor 33 turns the spindle 51 through the reduction gear mechanism 39. The turning force of the spindle 51 is transmitted through the second bevel gear 53 and the first bevel gear 25 meshing with the former bevel gear 53 to turn the screw turning socket 22 on its axis. The screw N, which has been partially driven into the work H is turned by the screw turning socket 22 and is further driven into the work H. Incidentally, the drive piston 7 can drive the screw N into the work H to the last without fail because it is held in its bottom dead center by the pressure of the compressed air until the trigger lever 15 is released from its pulling-up operations.

Moreover, FIG. 6 is a longitudinally sectional side elevation showing the joining portion of the tool body and the nose. In an opening 74 acting as a hole for receiving the drive piston rod 8 in the screw inserting bore 23 of the nose 3 which is integrally formed in the lower end of the tool body 2, there is fitted and arranged an annular rod guide member 75 for guiding the drive or striking piston rod 8 in the vertical directions of FIG. 6 such that the axis of the piston rod 8 may be aligned with the center of the screw inserting bore 34 of the nose 3.

The annular rod guide member 75 is formed with: a large diameter annular portion 77 which is fitted in position in a circular recess 76 formed in a bottom 2A in the tool body 2; and a small-diameter annular portion 78 which is formed integrally with the bottom face 77A of the former annular portion 77 and fitted in position in the opening 74. These annular portions 77 and 78 are formed with a rod receiving bore 79 which extends therethrough at the center. Moreover, the small-diameter annular portion 78 is formed in its lower end face 78A with a screw positioning projection 80 which projects forwardly of the screw feeding direction. The projection 80 has its length L made substantially equal to the height W1 of the head N′ of the screw N to be inserted into the screw inserting bore 23 of the nose 3. In other words, the projection 80 has its length sized not to adversely affect the pushing-out operation of the screw holder 47, which is to be pushed out through the push-out aperture 72 formed in the front side wall (i.e., the left hand wall portion of FIG. 6) of the nose 3, when the rod guide member 75 is arranged in the opening 74.

Thanks to the provision of the rod guide member 75 with the projection 80, the foremost screw N of the screw cassette 46, which is pushed out through a screw feed passage 105 to the screw inserting bore 23 of the nose 3 by the action of the screw feeder 61, has its head N' received by the projection 80 so that said screw N is positioned in the screw inserting bore 23 of the nose 3 to have its axis aligned with the axis of the striking piston rod 8.

As a result, even if an inertia force is applied in the feeding direction to the screw package or cassette 46 even during the feeding operation of the screw cassette 46, the screw N is always held in the state in which its axis is aligned with the axis of the striking piston rod 8, so that it can be smoothly driven out of the nose 3. Moreover, the screw N can be inserted into the socket unit 20, which is arranged at the leading end 3*a* of the nose 3, so that it can be driven stably and reliably into a predetermined position of the work H.

Moreover, the screw guide socket 21 shown in FIGS. 7*a* and 7*b* is rotatably arranged at the leading end 3*a* of the nose 3 and introduces the screw N, which is striken by the striking piston rod 8, from a circular opening 83, which has its one end 81 countersunk, as indicated at 82, into a hexagonal opening 85 at the other end 84 which is fitted for the hexagonal shape of the head N' of the screw N, thereby to smoothly guide the screw N into the hexagonal screw fitting bore 24 of the screw turning socket 22 leading from the below the other end 84.

Here, the construction of the screw guide socket 21 will be described in more detail. As is apparent from FIG. 7*b*, the screw guide socket 21 is formed at its center with the screw guide passage 86. From the one end 81 of the screw guide socket 21, moreover, there is formed the circular opening 83 which has the countersunk face 82 having its diameter gradually reduced toward the other end. The circular opening 83 has its minimum diameter portion 87 made to have a slightly larger diameter than that of the circle circumscribing the screw head N'. Between the circular opening 83 and hexagonal opening 85 arranged at the lower end portion 21*a* of the screw guide socket 21, there is formed such a guide face 89 for guiding each of the hexagonal ridges of the screw head N' from the minimum diameter portion 87 to the other end 84 and for reliably positioning each of hexagonal ridges 88 of the screw fitting bore of the screw turning socket 22 as is twisted at an angle of 60 degrees between the minimum diameter portion 87 and the other end 84. Moreover, the screw guide passage 86 is formed, as shown in FIGS. 7*c* to 7*e*, into a generally circular shape in the section *c—c* of the screw guide socket 21 and into a hexagonal shape in the section *e—e*.

As a result, the individual ridges of the hexagon of the screw head N' are guided by the guide face 89 of the screw guide passage 86 in the order of FIGS. 7*c* to 7*e*. The screw N can have its head N' threading such that its individual hexagonal ridges are accurately aligned with the ridges 88 of the hexagonal screw fitting bore 24 of the screw turning socket 22. FIG. 8 shows the detail of the screw tightening depth adjusting means of the aforementioned screw driver 5.

The socket holder 26 is fastened to the leading end 3*a* of the nose 3 by means of a stop screw 90. In the socket holder 26, there are borne rotatably by the bearings 27 and 27, respectively, both the screw guide socket 21 and the first bevel gear 25 which is fitted on and assembled with the lower end 21*a* of the screw guide socket 21. The one end 25*a* of the first bevel gear 25 extends more downward from the lower end 21*a* of the screw guide socket 21 until it is exposed to the outside of the socket holder 26 from a center hole 92 which is formed in a bottom plate 91 at the lower end of the socket holder 26. With the one end 25*a* of the first bevel gear 25, moreover, there is integrally assembled a leading end 22*a* of the screw turning socket 22 by means of both steel balls 93, which are retained in a plurality of through holes formed in the circumference of that one end 25*a* and a ring-shaped spring member 94 which is arranged on the outer circumferences of those steel balls 93. Moreover, the socket holder 26 is formed with an external thread 96 on the lower portion 95 of its outer circumference and is provided with an O-ring 97 which is fitted and retained in the annular groove formed in the upper outer circumference adjacent to that external thread 96. On this external thread 96 of the socket holder 26, there is screwed and supported a cylindrical adjustor 100, which is provided with a bottom plate 99 formed with a hole 98 at its center, so that the adjustor 100 can be moved in the axial direction when it is turned. Still moreover, the adjustor 100 has its cylindrical inner wall forced onto the aforementioned O-ring 97 so that it is prevented from any unnecessary rotation by the frictional resistance to its rotation.

The aforementioned adjustor 100 has its bottom plate 99 formed at its lower end face 99*a* with a circular step 101 adjacent to said center hole 98.

Moreover, the attachment 28 is formed at its upper end portion with an upper end face 28*a* which is arranged to face the circular step 101 so that it comes into abutment against the circular step 101 to stop the upward movement of the attachment 28. As a result, the upper limit of the movement of the attachment 28 can be arbitrarily set by turning the adjustor 100.

Thus, when the attachment 28 is thrusted onto the work H so that the screw turning socket 22 is then moved down together with the tool body 2, the upper end face 28*a* of the attachment 28 comes into abutment against the circular step 101 of the adjustor 100 so that the distance between the leading end face 22*a* of the screw turning socket 22 and the surface of the work H can be arbitrarily set by the number of the turns of the adjustor 100.

FIG. 9 shows the state in which the bottom plate 99 of the adjustor 100 is set at a slight spacing from the bottom plate 91 of the socket holder 26 by turning the adjustor 100 thereby to conduct the screw tightening operation. The tool body 2 is stopped at the position in which the circular step 101 of the adjustor 100 is in abutment against the upper end face 28*a* of the aforementioned attachment 28. As a result, the leading end portion 22*a* of the screw turning socket 22 is held at the desired spacing from the surface of the work H. Thus, as the screw N is impacted by the screw striker 4 while having its head N' floating above the surface of the work H and is then driven into the work H by turning the screw turning socket 22 of the screw driver 5, it is gradually driven down into the work H until the leading end portion 22*a* of the screw turning socket 22 is still fitted slightly on the upper end of the head of the screw N while the lower face of the screw head N' being in abutment against the surface of the work H. At the instant when the screw turning socket 22 is further turned, more specifically the screw N is further moved down to slightly depress the upper material of the work H and to release the fitting engagement between the screw head N′ and the screw turning socket 22.

Thus, the screw N is disengaged from the screw turning socket 22, when the upper face of its head N′ is spaced at the predetermined distance from the surface of the work H so that it is not tightened more than necessary. As a result, the damage of the surface of the work H can be minimized.

The screw tightening depth adjustor having the construction thus far described can enjoy its prominent effect especially in case the surface side member of the work H is made of a relatively soft material. Since the turning force by the socket is completely blocked before the head of the screw comes substantially wholly into the material, the operator is not required to confirm the tightening depth each time of the tightening operation.

FIG. 10 is a top plan view showing the portion of the screw feed passage of the screw feeder 61, and FIG. 11 is a longitudinally sectional view of the same. The screw feeder 61 is provided, as shown in FIG. 10, with a pair of screw guide plates 102 and 103 for guiding the run of the screw holder 47 of the screw cassette 46 which is fed from the magazine 60 into the screw inserting bore 23 of the nose 3. Of the guide plates 102 and 103, one screw guide plate 102 is made of a plate connecting the nose 3 and the magazine 60 whereas the other screw guide plate 103 is made of a door plate for opening and closing one side of the former screw guide plate 102. A hinging pin 104 providing the hinging axis of the other screw guide plate 103 is formed at a lateral portion of the nose 3. Between the individual screw guide plates 102 and 103, as shown in FIG. 11, there is formed a gap forming the screw feed passage 60H which has a width W2 made larger more or less than the width W3 of the head N′ of the screw N.

In order that the individual screw retaining walls 50A and 50B of the screw holder strip 47 may run straight, there are formed screw holding member guide grooves, designated generally at 106, which have a generally C-shaped section for guiding the runs of those individual screw retaining walls 50A and 50B. The guide grooves 106 are defined part by upper and lower wall portions 106A and 106B which guide the upper walls 50A and lower walls 50B of the holder strip 47 respectively. The groove 106 of the screw guide plate 103 includes wall portions 106C which guide the side walls 50C of the individual screw holding strip 47.

The individual side wall portions 106C are formed with an auxiliary groove 107 which has a generally C-shaped section for providing a relief portion for the adjacent side of the strip 47. The other side of the strip contains the gap 50H so that there is no need to accommodate side wall bulging. However in order to control the lateral position of the other side, the associated groove 106 includes wall portions 106D which laterally guide the other side of the strip exteriorly. It is important to note that the continuous connecting wall 50D is guided laterally interiorly by the vertical wall 67D. The continuous connecting wall 50D is supported vertically by the horizontal extent of the L-shaped support member 67C.

As a result, the screw holder 47 made of a flexible synthetic resin can be smoothly fed from the magazine 60 toward the nose 3 without any appreciable surface to surface sliding contact with the surfaces defining the individual guide grooves 106 so that the feed of the entire screw cassette 46 can be reliably accomplished.

The terms "upper" and "horizontally" as well as other terms such as "above", "below", "vertical", "forward", "rearward", as used hereinafter are to be construed in their relative sense.

It thus will be seen that the objects and advantages of this invention have been fully and effectively achieved. It will be realized, however, that the foregoing specific embodiments have been disclosed only for the purpose of illustrating the principles of this invention and are susceptible of modification without departing from such principles. Accordingly, the invention includes all embodiments encompassed within the spirit and scope of the following claims.

What is claimed is:

1. A fastener driving tool for driving successive fasteners supported in vertically extending parallel row formation by a horizontally elongated thin walled plastic carrier strip which includes a series of longitudinally spaced pairs of upper and lower fastener retaining walls, each pair of upper and lower walls extending generally horizontally and being disposed in generally vertical spaced parallel relation with respect to one another, a vertical wall connected between one pair of corresponding edges of each pair of upper and lower walls, the lower walls being longitudinally interconnected at their edges opposite from said one edge, a continuous wall longitudinally interconnecting the upper walls at their edges opposite from said one edge, said continuous wall extending vertically downwardly from the opposite edges of said upper walls and terminating in a lower edge forming a continuous longitudinally extending gap therebelow and above the interconnected opposite edges of said lower walls, said upper and lower walls having longitudinally spaced aligned pairs of openings formed in a central portions thereof configured to releasably support the fasteners with the axes extending vertically in a parallel row formation with respect to one another in such a way that the fasteners including the heads thereof can be moved axially therefrom without substantially unbalanced transverse forces being applied thereto, the lower edge of said continuous wall having a multiplicity of notches therein opening into said gap spaced apart a longitudinal distance generally equal to the longitudinal spacing between fasteners, said tool comprising a tool body having means defining a fastener drive track, a fastener driving element mounted in said drive track for movement through successive operative cycles each including a drive stroke and a return stroke, a magazine providing a interior space for retaining a coiled carrier strip with supported fasteners, guide passage means leading from said magazine to said drive track along which a leading end portion of said strip with supported fasteners can be moved, and fastener feeding means for moving the leading end portion of the strip with fasteners along said guide passage means, said feeding means including a L-shaped member having a horizontally extending portion and a vertical portion extending upwardly therefrom, said L-shaped member being disposed with respect to said guide passage means such that the horizontal extending portion extends through the gap in said strip and the vertically extending portion extends alongside the inner surface of the continuous wall of said strip, said feeding means including feeding pawl means mounted for movement through successive operative cycles each of which includes a feed stroke and a return stroke, and means for effecting movement of said feeding pawl means such that the same will be engaged within a strip notch at the end of each return stroke so that said strip will be moved with said feeding pawl means during the drive stroke thereof.

2. A fastener driving tool as defined in claim 1 wherein said movement effecting means includes a feed piston slidably sealingly mounted within a feed cylinder on said tool body, and a piston rod fixed to said feed piston, said L-shaped member being fixed with respect to said piston rod for movement therewith and said feeding pawl means being mounted for movement with said piston rod.

3. A fastener driving tool as defined in claim 2 wherein said feeding pawl means includes a pawl member pivotally mounted with respect to said piston rod for movement between a strip feeding position and a strip bypassing position and spring means for resiliently urging said pawl member into said strip feeding position.

4. A fastener driving tool as defined in claim 3 wherein said pawl member is mounted immediately above the horizontal portion of said L-shaped member in a position to engage within an associated notch when in said feeding position.

5. A fastener driving tool as defined in claim 4 wherein said tool includes means for turning a fastener into a workpiece after said fastener driving element has driven the same partially into the workpiece.

6. A fastener driving tool as defined in claim 5 wherein said magazine includes a fixed section and a movable section mounted with respect to the fixed section for movement between a closed operative position and an opened access position, said fixed section including a fixed circular bottom wall, a fixed semi-cylindrical peripheral wall extending upwardly from a peripheral edge portion of said bottom wall, a fixed semi-circular top wall extending from the upper edge of said fixed peripheral wall, said movable section including a movable peripheral wall and a movable top wall extending from the upper edge of said movable peripheral wall, said movable walls being cooperable with said fixed walls when said movable section is in the closed operative position to define a cylindrical space for receiving a coiled fastener package, selected from a series of coiled fastener packages having different axial dimensions dependent upon the length of the shanks of the fasteners in the coiled package and spring means carried by said fixed bottom wall in a position to engage the bottom of the coiled package so as to support the same with the headed ends of the fasteners thereof adjacent said top walls when said movable section is in said closed operative position.

7. A fastener driving tool as defined in claim 6 wherein said spring means comprises an elongated spring plate having one end fixed to said bottom wall at a position within the semi-circular portion thereof opposite from the portion from which said fixed semi-cylindrical peripheral wall extends, said spring plate when unstressed extending upwardly and outwardly from said one end in a direction toward said fixed peripheral wall.

8. A fastener driving tool as defined in claim 1 wherein said magazine includes a fixed section and a movable section mounted with respect to the fixed section for movement between a closed operative position and an opened access position, said fixed section including a fixed circular bottom wall, a fixed semi-cylindrical peripheral wall extending upwardly from a peripheral edge portion of said bottom wall, a fixed semi-circular top wall extending from the upper edge of said fixed peripheral wall, said movable section including a movable peripheral wall and a movable top wall extending from the upper edge of said movable peripheral wall, said movable walls being cooperable with said fixed walls when said movable section is in the closed operative position to define a cylindrical space for receiving a coiled fastener package, selected from a series of coiled fastener packages having different axial dimensions dependent upon the length of the shanks of the fasteners in the coiled package, and spring means carried by said fixed bottom wall in a position to engage the bottom of the coiled package so as to support the same with the headed ends of the fasteners thereof adjacent said top walls when said movable section is in said closed operative position.

9. A fastener driving tool as defined in claim 8 wherein said spring means comprises an elongated spring plate having one end fixed to said bottom wall at a position within the semi-circular portion thereof opposite from the portion from which said fixed semi-cylindrical peripheral wall extends, said spring plate when unstressed extending upwardly and outwardly from said one end in a direction toward said fixed peripheral wall.

* * * * *